US011849766B2

(12) United States Patent
Chen et al.

(10) Patent No.: US 11,849,766 B2
(45) Date of Patent: Dec. 26, 2023

(54) AEROSOL-GENERATING DEVICE

(71) Applicant: SHENZHEN YUYAN INDUSTRIAL LIMITED, Shenzhen (CN)

(72) Inventors: Bin Chen, Shenzhen (CN); Yong-Hui Lin, Shenzhen (CN)

( * ) Notice: Subject to any disclaimer, the term of this patent is extended or adjusted under 35 U.S.C. 154(b) by 582 days.

(21) Appl. No.: 17/105,509

(22) Filed: Nov. 26, 2020

(65) Prior Publication Data

US 2021/0076741 A1 Mar. 18, 2021

Related U.S. Application Data

(63) Continuation of application No. PCT/CN2019/079902, filed on Mar. 27, 2019.

(30) Foreign Application Priority Data

May 30, 2018 (CN) ..... 201810539989.1
Jan. 7, 2019 (CN) ..... 201910012532.X

(51) Int. Cl.
*A24F 40/46* (2020.01)
*A24F 40/42* (2020.01)
*A24F 40/20* (2020.01)

(52) U.S. Cl.
CPC ..... *A24F 40/46* (2020.01); *A24F 40/42* (2020.01); *A24F 40/20* (2020.01)

(58) Field of Classification Search
CPC ..... A24F 40/46; A24F 40/42; A24F 40/20
See application file for complete search history.

(56) References Cited

U.S. PATENT DOCUMENTS 9,693,587 B2 * 7/2017 Plojoux ..... A61M 15/06
10,791,765 B2 * 10/2020 Li ..... A24F 40/57
11,197,497 B2 * 12/2021 Lee ..... A24F 40/65
11,252,999 B2 * 2/2022 Lee ..... A24F 40/20
(Continued)

FOREIGN PATENT DOCUMENTS

CN 201881694 U 6/2011
CN 103997922 8/2014
(Continued)

OTHER PUBLICATIONS

International Search Report of PCT/CN2019/079902.

*Primary Examiner* — Neil Abrams

(57) ABSTRACT

The present disclosure relates to an aerosol-generating device, including a heater, a bottom support, a drive assembly, and a linkage assembly. The heater is configured to be inserted into an aerosol-generating article to heat an aerosol-generating material therein to generate aerosol. The bottom support is slidably connected to a housing defining the accommodating cavity. A movement direction of the bottom support is parallel to a length direction of the accommodating cavity. The drive assembly is movably coupled to the heater assembly and configured to push or drawn the heater assembly to slide between a heating position and a separation position. The linkage assembly is configured to trigger movement of the bottom support toward an insertion opening of the accommodating cavity when the heater approaches or reaches the separation position to extract the aerosol-generating article from the accommodating cavity.

20 Claims, 14 Drawing Sheets

(56) References Cited

U.S. PATENT DOCUMENTS

| | | | | |
|---|---|---|---|---|
| 11,647,785 | B2 * | 5/2023 | Lee | A24F 40/46 131/329 |
| 2021/0076741 | A1 * | 3/2021 | Chen | A24F 40/42 |
| 2022/0125109 | A1 * | 4/2022 | Batista | A24F 40/53 |
| 2023/0136305 | A1 * | 5/2023 | Li | H05B 6/105 131/329 |

FOREIGN PATENT DOCUMENTS

| | | | |
|---|---|---|---|
| CN | 203884698 | | 10/2014 |
| CN | 204483029 | | 7/2015 |
| CN | 204682530 | | 10/2015 |
| CN | 205072073 | | 3/2016 |
| CN | 205597118 | | 9/2016 |
| CN | 107249362 | | 10/2017 |
| CN | 107581657 | | 1/2018 |
| CN | 207220157 | U | 4/2018 |
| CN | 108618205 | A | 10/2018 |
| CN | 208064484 | U | 11/2018 |
| CN | 109043674 | A | 12/2018 |
| EP | 3179828 | A1 | 6/2017 |
| JP | 2006320287 | A | 11/2006 |
| JP | 4611801 | | 1/2011 |
| WO | WO2013076098 | | 5/2013 |
| WO | WO2017202959 | A2 | 11/2017 |

* cited by examiner

AEROSOL-GENERATING DEVICE

CROSS-REFERENCE TO RELATED APPLICATIONS

This application claims priorities of China Patent Application No. 201810539989.1, filed on May 30, 2018, entitled "AEROSOL-GENERATING DEVICE" and China Patent Application No. 201910012532.X, filed on Jan. 7, 2019, entitled "AEROSOL-GENERATING DEVICE", the contents of which are hereby incorporated by reference in their entirety. This application is a continuation under 35 U.S.C. § 120 of international patent application PCT/CN2019/079902, filed on Mar. 27, 2019, the content of which is also hereby incorporated by reference in its entirety.

TECHNICAL FIELD

The present disclosure relates to an aerosol-generating device.

BACKGROUND

A heat-not-burn cigarette is also called a low-temperature cigarette or a new-type cigarette, featured primarily in heating, not burning, tobacco by an external heat source. For the reason that the heating temperature is much lower than the combustion temperature, harmful components produced by thermal pyrolysis and thermal synthesis in high-temperature combustion of tobacco can be effectively eliminated, and a release amount of chemical components in mainstream smoke can be greatly reduced.

The low-temperature cigarette with plug-in typed heating is a relatively common form. The international application PCT/EP2012/073135 discloses an extractor used in an aerosol-generating device. The extractor includes a sliding receptacle for receiving a smoking article and a sleeve for receiving the sliding receptacle. The sliding receiver is slidable in the sleeve between a first position and a second position. In the first position, an aerosol-forming substrate of the smoking article is positioned, so as to be heated by a heater. In the second position, the aerosol-forming substrate is substantially separated from the heater. However, operating convenience of the extractor is another issue that needs to be addressed promptly.

SUMMARY

In view of this, there is a need to provide an aerosol-generating device.

The present disclosure provides an aerosol-generating device, including:

a housing provided with an accommodating cavity configured to accommodate an aerosol-generating article;

a heater assembly including a heater and a base fixing the heater, the heater being configured to be inserted into the aerosol-generating article to heat an aerosol-generating material in the aerosol-generating article, thereby generating aerosol;

a bottom support slidably connected to the housing defining the accommodating cavity, a movement direction of the bottom support being parallel to a length direction of the accommodating cavity;

a drive assembly movably coupled to the heater assembly and configured to push or drawn the heater assembly, thereby allowing the heater assembly to slide between a heating position and a separation position, the heating position being a position of the heater that is extended into the accommodating cavity, the separating position being another position of the heater that is withdrawn out and away from the accommodating cavity; and a linkage assembly configured to trigger a movement of the bottom support toward an insertion opening of the accommodating cavity when the heater approaches or reaches the separation position.

In an embodiment of the present disclosure, the aerosol-generating device further includes an extraction assembly configured to assist the aerosol-generating article in exiting the accommodating cavity, wherein the extraction assembly includes the bottom support, and the bottom support is configured to abut against an air inlet end of the aerosol-generating article.

In an embodiment of the present disclosure, the linkage assembly includes:

a retainer configured to restrict the bottom support to a bottom of the accommodating cavity; and a pulling member configured to generate a force on the retainer, when the heater approaches or reaches the separation position, the pulling member pulls the retainer, causing the retainer to lose the restriction on the bottom support.

In an embodiment of the present disclosure, the bottom support is connected to an elastic member, and the elastic member is configured to pull the bottom support, causing the bottom support to move toward the insertion opening of the accommodating cavity.

In an embodiment of the present disclosure, the linkage assembly includes:

a first member disposed on the bottom support or fixedly connected to the bottom support;

and a second member, wherein the second member is bonded to the first member when the heater approaches or reaches the separation position.

In an embodiment of the present disclosure, the second member and the first member are bonded by any one of magnetic attraction, bonding, and snapping.

In an embodiment of the present disclosure, the first member is a fixing hoop fixedly connected to the bottom support, and the fixing hoop surrounds an outer periphery of a tubular wall defining the accommodating cavity.

In an embodiment of the present disclosure, the bottom support and the fixing hoop are fixedly connected by snapping or interference fit.

In an embodiment of the present disclosure, at least a part of the second member is a magnet, which is bonded to the first member by magnetic attraction.

In an embodiment of the present disclosure, the second member includes a substrate and a magnet fixed on the substrate.

In an embodiment of the present disclosure, the substrate is provided with at least one mounting hole for fixing the magnet.

In an embodiment of the present disclosure, the substrate is an annular plastic substrate.

In an embodiment of the present disclosure, the substrate is a strength-enhancing substrate.

In an embodiment of the present disclosure, the strength-enhancing substrate is a metal substrate.

In an embodiment of the present disclosure, the aerosol-generating device further includes a tubular member, wherein the heater assembly is fixed inside the tubular member, and the tubular member is connected to or movably coupled to the drive assembly.

In an embodiment of the present disclosure, the second member is a part of the tubular member or abuts against the tubular member, and the second member gradually approaches the first member while the tubular member moves from the heating position to the separation position.

In an embodiment of the present disclosure, a shape of the base is adapted to a hollow interior of the tubular member, and an outer edge of the base fits tightly with an inner wall of the tubular member.

In an embodiment of the present disclosure, the tubular member surrounds an outer periphery of the heater.

In an embodiment of the present disclosure, the tubular member is provided with a slot aperture, and a protrusion on the base is protruded into the slot aperture and is restricted in position.

In an embodiment of the present disclosure, the slot aperture extends along a length direction of the tubular member.

In an embodiment of the present disclosure, a connecting member is fixedly disposed at one end, away from the heater, of the tubular member, and the drive assembly is connected to or movably coupled to the tubular member through the connecting member.

In an embodiment of the present disclosure, the aerosol-generating device further includes a fixing auxiliary, wherein the fixing auxiliary is disposed in the hollow interior of the tubular member, one end of the fixing auxiliary abuts against the base of the heater, and another end of the fixing auxiliary abuts against the connecting member.

In an embodiment of the present disclosure, a crossbeam is disposed on the housing, and the crossbeam is inserted into the slot aperture and slides along the slot aperture while the tubular member moves.

In an embodiment of the present disclosure, the crossbeam penetrates the tubular member along a direction perpendicular to the length direction of the tubular member.

In an embodiment of the present disclosure, the bottom support is provided with a hole through which the heater is capable of being inserted into the aerosol-generating article received in the accommodating cavity.

The embodiments of the present disclosure adopt the linkage assembly to drive the bottom support to move, so as to assist the extraction of the aerosol-generating article. The linkage assembly approaches the bottom support during the withdrawal of the heater assembly, and drives the bottom support to move toward the insertion opening of the accommodating cavity while the heater assembly returns back in place, so as to push the aerosol-generating article out from the accommodating cavity. The extraction process of the aerosol-generating article is thereby more convenient than manual removal.

DETAILED DESCRIPTION

Figure 1:
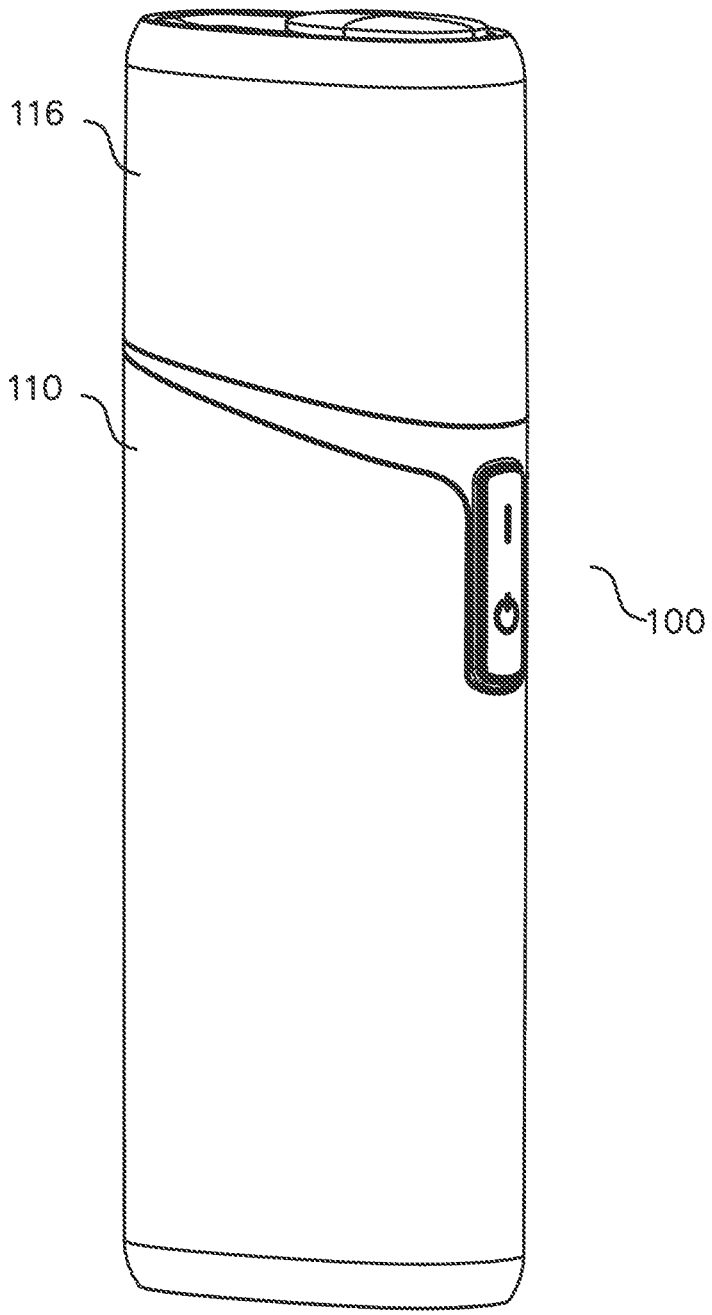
FIG. 1 is a schematic structural view of an aerosol-generating device provided by an embodiment of the present disclosure.
Figure 2:
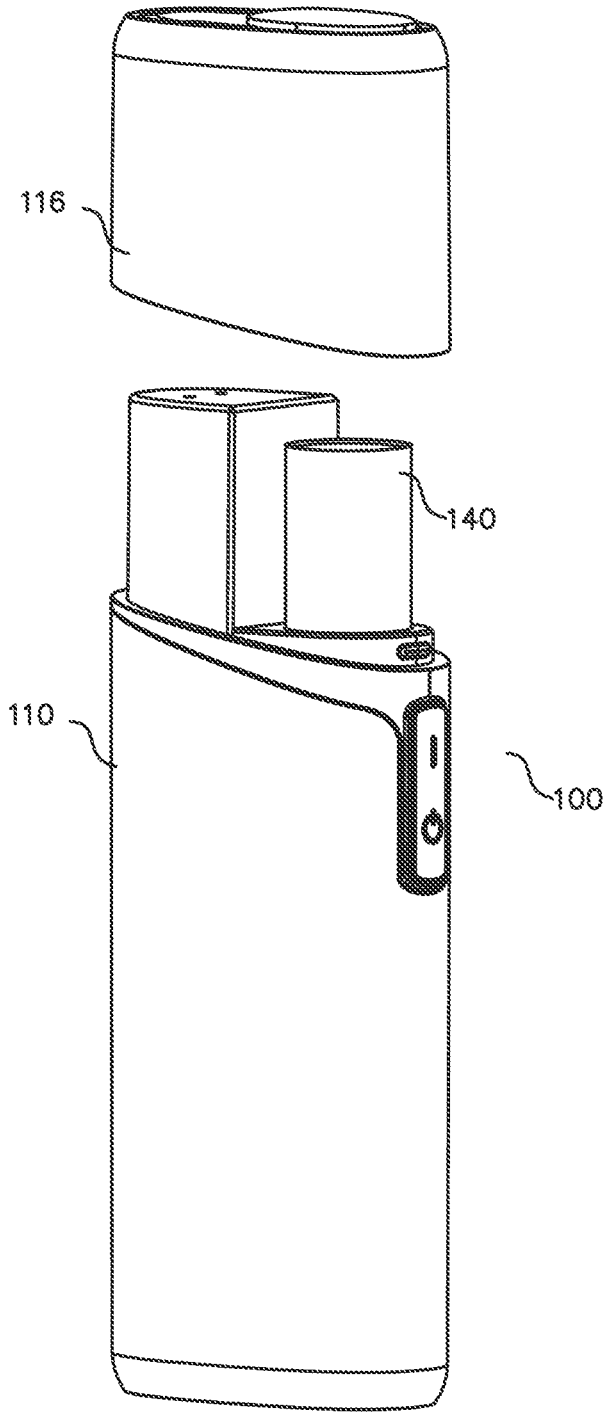
FIG. 2 is a use state view of the aerosol-generating device with an opened cover provided by an embodiment of the present disclosure.
Figure 3:
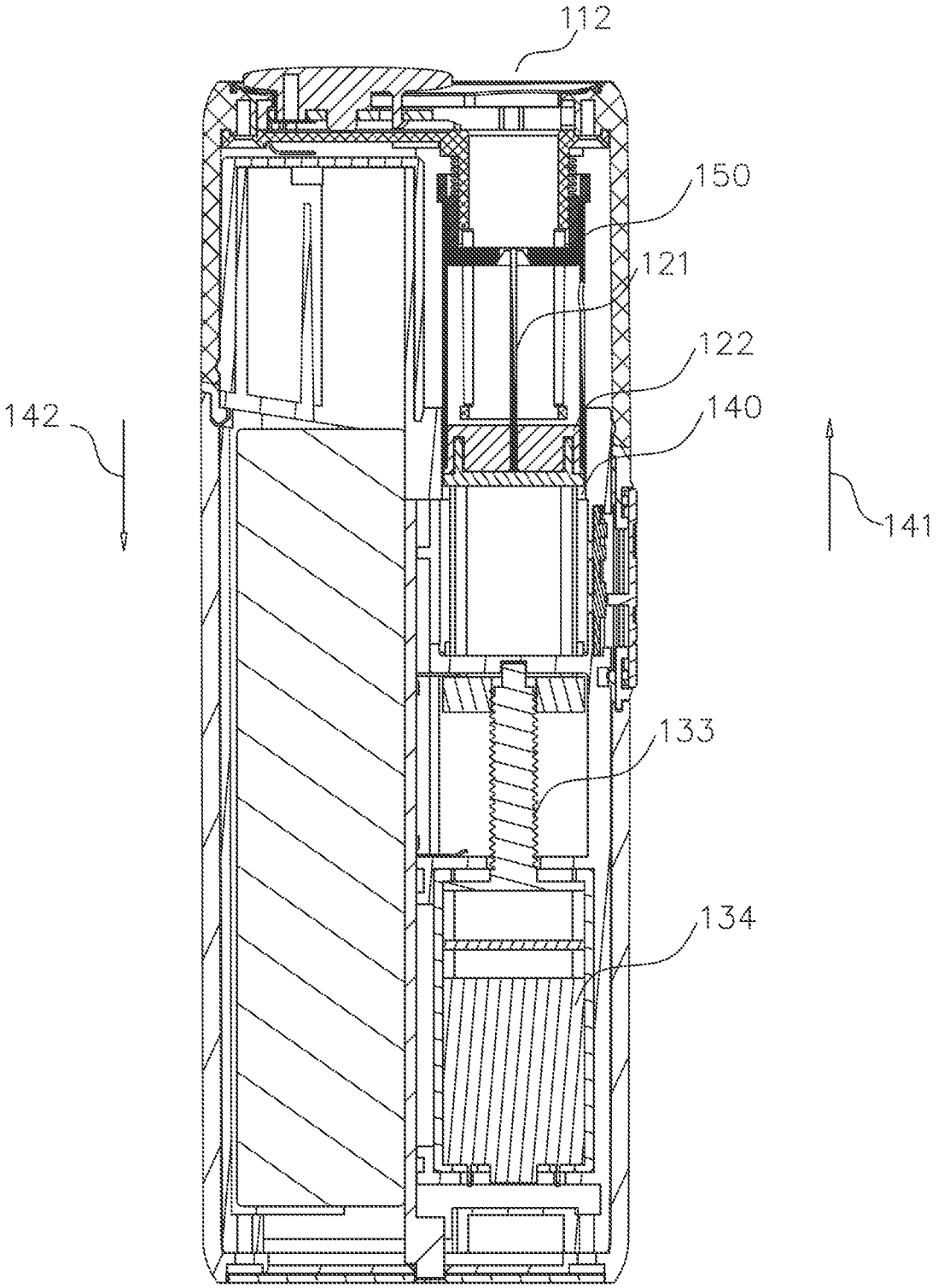
FIG. 3 is a schematic sectional structural view of the aerosol-generating device provided by an embodiment of the present disclosure.
Figure 4:
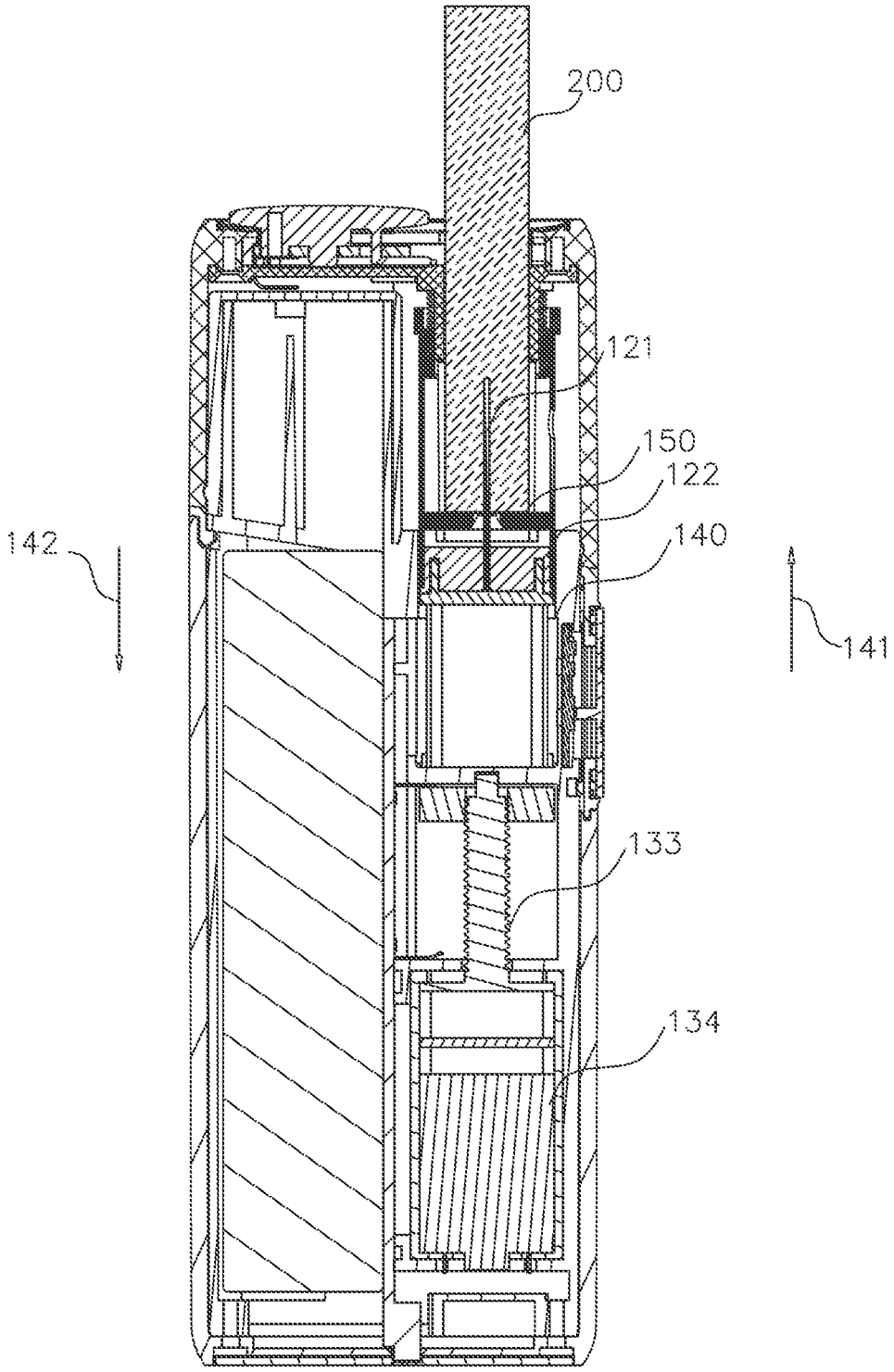
FIG. 4 is a sectional view of the aerosol-generating device with a heater in a heating position, provided by an embodiment of the present disclosure.
Figure 5:
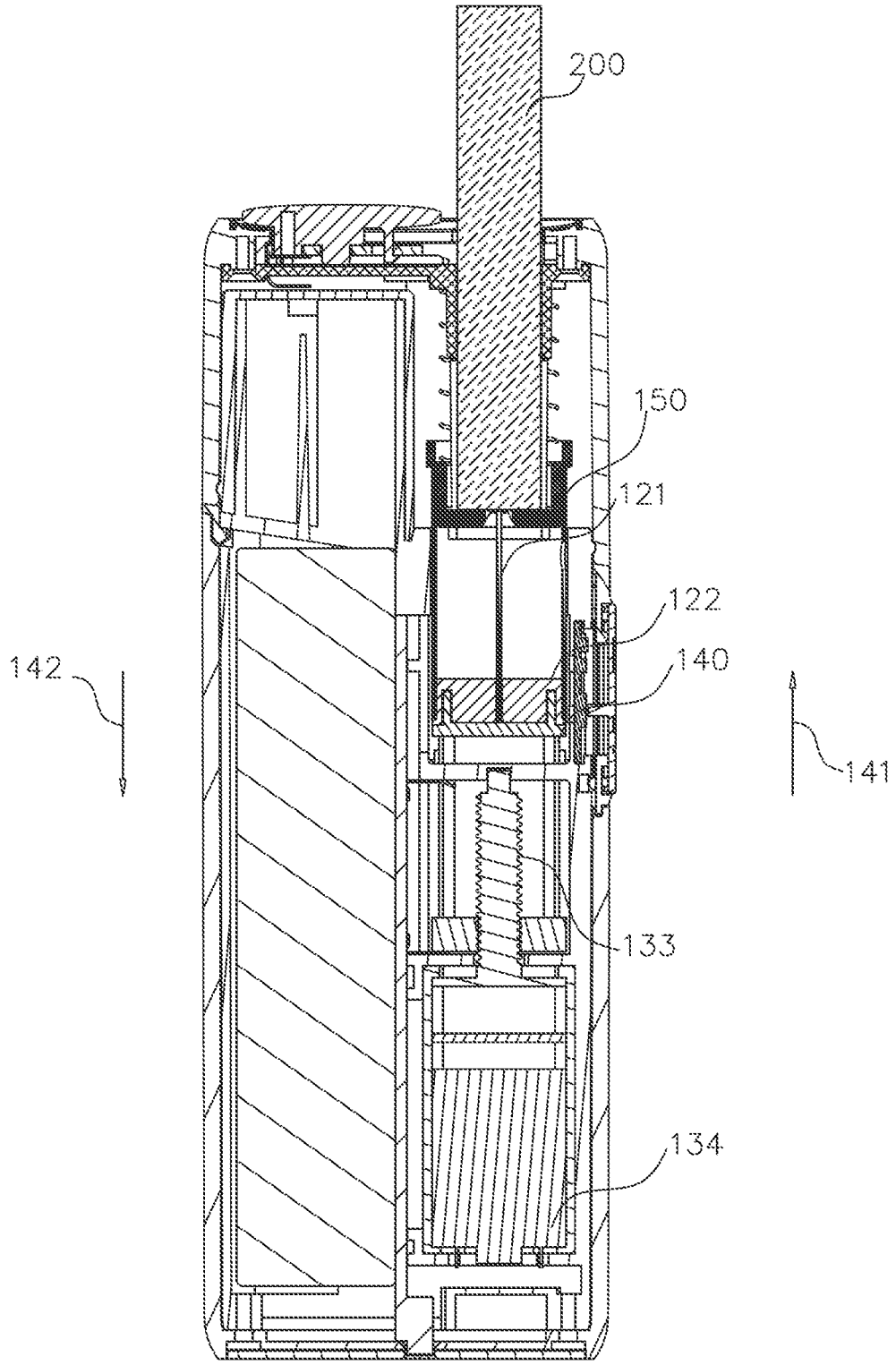
FIG. 5 is a sectional view of the aerosol-generating device with the heater in a separation position, provided by an embodiment of the present disclosure.
Figure 6:
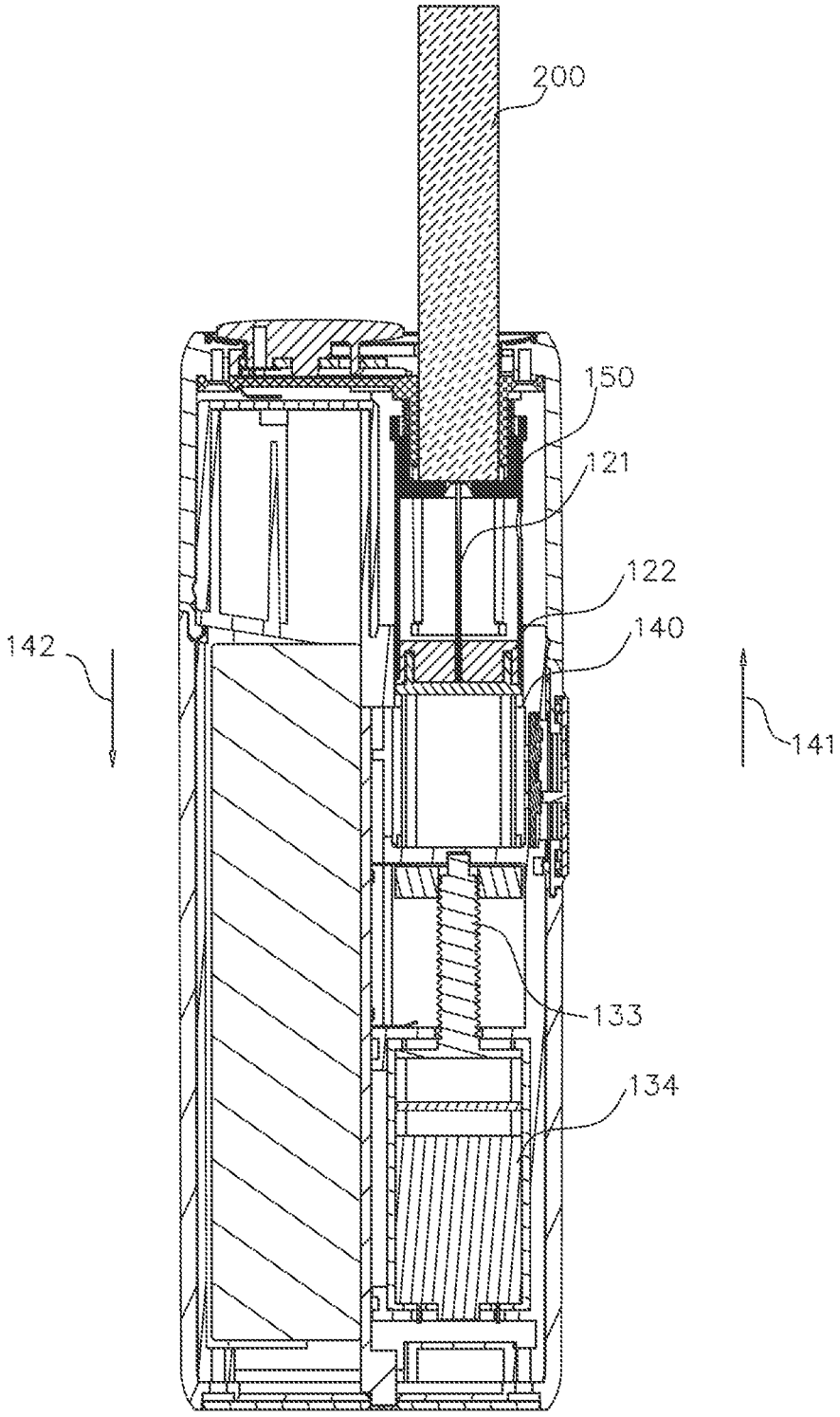
FIG. 6 is a sectional view of the aerosol-generating device with the heater returned from the separation position to the heating position, provided by an embodiment of the present disclosure.

The present disclosure will now be described in detail with reference to the accompanying drawings and embodiments in order to make the objects, technical solutions, and advantages of the present disclosure more clear. It should be understood that the specific embodiments described herein are only for explaining the present disclosure, and not intended to limit the present disclosure.

In the present disclosure, an element, when referred to as being "fixed" or "connected" to another element, may be directly fixed or connected to the another element or via an intermediate element. Rather when an element is referred to as being "directly" fixed or connected to another element, there is no intermediate element. When an element is referred to as "coupled" to another element, the elements are linked to realize a function of a machine, including dynamic coupling and static coupling. Such terms as "vertical", "horizontal", "left", "right" and the like used herein are for illustrative purposes only. The drawings are not necessarily drawn to scale, and various parts are drawn for better illustration of the embodiments.

In the embodiments of the present disclosure, the term "aerosol-generating material" refers to a smoke-generating material, which is a material that can release flavor and/or nicotine and/or smoke when heated or burned, that is, a material that can be atomized, that is, a smoking material. The smoking material can be in a solid, semi-solid, or liquid state. In considerations of air permeability, assembly, manufacture, etc., the solid smoking material is often processed into thin sheets, so is often called "sheets". Shredded sheets are also called smoking cuts. The smoking material mentioned in the embodiments of the present disclosure can be natural or synthetic smoking liquid, smoking oil, smoking glue, smoking paste, smoking cuts, tobacco leaves, etc. In an example, the synthetic smoking material contains glycerin, propylene glycol, nicotine, etc. The smoking liquid is in a liquid state, the smoking oil is oily, the smoking gel is gelatinous, and the smoking paste is creamy. The smoking cuts include natural, or synthetic, or extracted and processed smoking cuts. The tobacco leaves include natural, or synthetic, or extracted and processed tobacco leaves. The smoking material can be heated in the form of being sealed by other substances, such as stored in a thermally degradable packaging, e.g., in a microcapsule. After heated, prescribed volatile substances are released from the degraded or porous sealed packaging.

In the embodiments of the present disclosure, the smoking material may or may not contain nicotine. The smoking material containing nicotine can include at least one of smoking liquid, smoking oil, smoking glue, smoking paste, smoking cuts, tobacco leaves, and the like made from nicotine-containing materials and natural tobacco leaf products. The smoking liquid is in a liquid state, the smoking oil is oily, the smoking gel is gelatinous, and the smoking paste is creamy. The smoking cuts include natural, or synthetic, or extracted and processed smoking cuts. The tobacco leaves include natural, or synthetic, or extracted and processed tobacco leaves. The smoking material without nicotine mainly includes a flavor substance, such as a spice, which can be atomized to simulate the smoking process and assist to quit smoking. In an embodiment, the spice can include peppermint oil. The smoking material can also include other additives, such as glycerin and/or propylene glycol.

In the embodiments of the present disclosure, the term "aerosol-generating article" refers to a product, e.g., a cigarette, a cartridge, or a smoking stick, containing the smoking material and being capable of generating aerosol, e.g., smoke or mist, by heating. In an embodiment, the aerosol-generating article is a disposable product. The aerosol-generating article itself cannot provide electrical energy.

In the embodiments of the present disclosure, the term "aerosol-generating device" refers to a device, e.g., a smoking device, configured to provide electrical energy to an aerosol-generating article.

Referring to FIG. 1 to FIG. 8 and FIG. 12, an embodiment of the present disclosure provides an aerosol-generating device 100, which is used to heat an aerosol-generating article 200, thereby generating aerosol for a user to puff. The embodiment of the present disclosure provides the aerosol-generating device 100, which includes a housing 110, a heater assembly 120, and a tubular member 140. The housing 110 is configured to receive the aerosol-generating article 200. When in use, a heater 121, which is a heat-generating part of the heater assembly 120, extends into an accommodating cavity 111 of the housing 110. The aerosol-generating article 200 that is inserted into the accommodating cavity 111 of the housing 110 can be heated to generate aerosol.

In the aerosol-generating device 100 provided by the embodiments of the present disclosure, a drive assembly 130 is configured to push or draw the heater 121, so that the heater 121 slides between a heating position and a separation position. The heating position is a position of the heater 121 that is extended into the accommodating cavity 111. The separation position is a position of the heater 121 that is withdrawn out and away from the accommodating cavity 111. For example, the drive assembly 130 pushes or draws the heater assembly 120, so that the heater assembly 120 slides between the heating position and the separation position under an action of an external force. The heating position is the position of the heater 121 that is completely inserted into the aerosol-generating article 200, and is the deepest position that the heater 121 extends into the accommodating cavity 111. At this time, as long as the aerosol-generating article 200 is received in the accommodating cavity 111, the aerosol-generating article 200 can be heated to generate aerosol. The separation position is the position of the heater 121 that is completely withdrawn out from the accommodating cavity 111, and is the farthest position reached by the heater 121 withdrawn out and away from the accommodating cavity 111. The heater 121 at the separation position is not in contact with the aerosol-generating article 200 that is located in the accommodating cavity 111. After the heating of the aerosol-generating article 200 is completed, the heater assembly 120 is pushed or drawn to slide from the heating position to the separation position, during which the heater 121 is gradually withdrawn out from the accommodating cavity 111 to realize the separation of the heater 121 from the aerosol-generating article 200.

An extraction assembly 150 is configured to assist the aerosol-generating article 200 in exiting the accommodating cavity 111. In an embodiment, the extraction assembly 150 includes a bottom support 151 and a linkage assembly. The bottom support 151 abuts against an air inlet end of the aerosol-generating article 200. The linkage assembly is configured to trigger the bottom support 151. The bottom support 151 is slidably connected to the housing which defines the accommodating cavity 111, and can move along a length direction of the accommodating cavity 111. The length direction of the accommodating cavity 111 is an extension direction between a bottom of the accommodating cavity 111 and an opening 112 of the accommodating cavity 111, and is also a direction along which the aerosol-generating article 200 is inserted into and extracted from the accommodating cavity 111. The movement direction of the bottom support 151 is parallel to the length direction of the accommodating cavity 111.

Since the smoking material, which is a smoke-generating material, is prepared by using natural tobacco leaf ingredients and/or other smoke-generating materials, a small amount of oily liquid substances including tar and a small amount of solid residues of the smoking material may seep out during the heating process. These liquid and solid substances could be remained in the accommodating cavity 111 and on the heater 121 of the smoking device. The seeped out substances may enter an internal space of the smoking device, resulting in odorous substances that affect the use and are hard to be cleaned, especially, the liquid substances flown into the area where a circuit board or a battery locates may cause serious damage to these devices. In the present disclosure, a tubular member 140 is disposed to surround and fix the heater assembly 120, thereby forming a space 160 for preventing substance leakage. For example, the tubular member 140 has a hollow interior, and the heater assembly 120 is fixed in the hollow interior. A base 122 and an inner wall of the tubular member 140 enclose the space 160 for preventing substance leakage, so that not only the liquid substances generated by heating but also the solid substances such as tobacco shreds will be confined in the space 160 without contaminating other places, as well as not inducing damages to electronic components. In some embodiments, the tubular member 140 also functions as connecting the drive assembly 130. The drive assembly 130 directly acts on the tubular member 140, so that the tubular member 140 is movably coupled to the housing 110, thereby driving the heater assembly 120 to withdraw out from the accommodating cavity 111, while the aerosol-generating article 200 is still remained in the accommodating cavity 111, in order to realize the separation of the heater 121 from the aerosol-generating article 200, avoid an adhesion between the heater 121 and a heated aerosol-generating material, and facilitate the removal of the aerosol-generating article 200.

In an embodiment, a shape of the base 122 is adapted to the hollow interior of the tubular member 140. An upper surface of the base 122 is a complete surface without an opening. An outer edge of the base 122 fits tightly with the inner wall of the tubular member 140, so that the upper surface of the base 122 and the inner wall of the tubular member 140 jointly define the space 160 for preventing substance leakage. Since the base 122 and the tubular member 140 are perfectly matched, residues will not leak from a contact position therebetween. As a result, the substances will not leak as long as the base 122 and the inner wall of the tubular member 140 have no opening.

In the aerosol-generating device 100 provided by an embodiment of the present disclosure, the housing 110 is provided with the accommodating cavity 111 for accommodating the aerosol-generating article 200. In an embodiment, the housing 110 defines the opening 112 communicating with the accommodating cavity 111, to allow the aerosol-generating article 200 to insert into the accommodating cavity 111 from the opening 112. The opening 112 can be also called a smoking stick insertion opening or an insertion opening of the accommodating cavity. The tubular wall of the housing 110 that defines the accommodating cavity 111 can include a side wall 113 and a bottom wall 114, which are connected to each other to form a cup-shaped structure and capable of defining the accommodating cavity 111. In an embodiment, the shape of the accommodating cavity 111 is adapted to the shape of the aerosol-generating article 200, so that the aerosol-generating article 200 inserted into the accommodating cavity 111 will not be easily taken out by a mouth, and the tubular wall defining the accommodating cavity 111 will not squeeze the aerosol-generating article 200 to induce excessive deformation, and the resistance to draw (RTD) will thereby not be increased.

In an embodiment, the tubular wall of the tubular member 140 extends toward the opening 112 and surrounds the outer periphery of the heater 121, which not only protects the heater 121, but also allows the space 160 for preventing material leakage to extend toward the opening 112. The residues can be entirely collected in the space 160, which is convenient for centralized cleaning.

In an embodiment, the housing 110 includes a cover 116, and the accommodating cavity 111 is located in the cover 116. When the cover 116 is removed, an upper portion of the tubular member 140 is exposed, thereby facilitating the cleaning.

In the aerosol-generating device 100 provided by an embodiment of the present disclosure, the heater assembly 120 includes a heater 121 and a base 122 fixing the heater 121. The base 122 can fix the heater 121 by embedding, clamping, etc. The base 122 and the heater 121 can be integrally formed, for example, through injection molding or ceramic sintering. The heater 121 is configured to be inserted into the aerosol-generating article 200 to heat the aerosol-generating material in the aerosol-generating article 200, thereby generating aerosol. The heater 121 includes one or more electric heating members. In an embodiment, the electric heating members are resistive materials, which convert electrical energy into thermal energy to heat the aerosol generating substance, thereby generating aerosol. In an embodiment, the electric heating member is combined with insulating materials such as ceramics to form a needle-shaped, rod-shaped, or sheet-shaped heater 121 with fair strength. At least a part of the heater 121 is configured to be inserted into the aerosol-generating material of the aerosol-generating article 200.

In the aerosol-generating device 100 provided by an embodiment of the present disclosure, the drive assembly 130 is connected or movably coupled to the tubular member 140, and pushes or draws the tubular member 140 to move relative to the housing 110. Under the traction by the tubular member 140, the heater 121 is pushed or drawn by the drive assembly 130 to slide between the heating position and the separation position. The heating position is the position of the heater 121 that is extended into the accommodating cavity 111. The separation position is the position of the heater 121 that is withdrawn out from the accommodating cavity 111. For example, the drive assembly 130 pushes or draws the heater assembly 120, so that the heater assembly 120 slides between the heating position and the separation position under the action of the external force. The heating position is the position of the heater 121 that is completely inserted into the aerosol-generating article 200, and is the deepest position that the heater 121 extends to in the accommodating cavity 111. At this time, as long as the aerosol-generating article 200 is received in the accommodating cavity 111, the aerosol-generating article 200 can be heated to generate aerosol. The separation position is the position of the heater 121 that is completely withdrawn out from the accommodating cavity 111, and is the farthest position reached by the heater 121 withdrawn out and away from the accommodating cavity 111. The heater 121 at the separation position is not in contact with the aerosol-generating article 200 that is located in the accommodating cavity 111. After the heating of the aerosol-generating article 200 is completed, the heater assembly 120 is pushed or drawn to slide from the heating position to the separation position, during which the heater 121 is gradually withdrawn out from the accommodating cavity 111 to realize the separation of the heater 121 from the aerosol-generating article 200.

In an embodiment, the heating position, also can be called a working position, is the position where the heater 121 heats the aerosol-generating article 200. When the heater assembly 120 is located at the heating position, it waits for an aerosol-generating article 200 to be inserted into the accommodating cavity 111, or if there is already an aerosol-generating article 200 inserted into the accommodating cavity 111, waiting to be heated or being heated. The separation position is the position of the heater 121 that is completely separated from the aerosol-generating article 200. When the heater assembly 120 is located at the separation position, it means that the heater 121 and the aerosol-generating article 200 have been completely separated, and the aerosol-generating article 200 can be directly removed. After the aerosol-generating article 200 has completed heating and is removed, the heater assembly 120 needs to be pushed back to the position extending into the accommodating cavity 111 and wait for the next work.

Referring to FIGS. 9 to 13 in conjunction with the above-described embodiments, the movement mechanism and moving methods of the present disclosure are described in detail. In an embodiment, the drive assembly 130 includes a sliding button 131, and the sliding button 131 is movably coupled to the housing 110. For example, the sliding button 131 can slide along the housing 110. For the convenience of description, a direction along which the heater assembly 120 moves toward the opening 112 is called a first direction 141, and a direction along which the heater assembly 120 withdraws out from the accommodating cavity 111 is called a second direction 142. Obviously, the first direction 141 is also the direction along which the heater assembly 120 moves from the separation position to the heating position, during which the heater assembly 120 is pushed upward since the accommodating cavity 111 is stationary relative to the housing 110, that is, the heater assembly 120 is pushed toward the aerosol-generating article 200. The second direction 142 is also the direction along which the heater assembly 120 moves from the heating position to the separation position, during which the heater assembly 120 is moved backward, that is, the heater assembly 120 is moved away from the aerosol-generating article 200. A part of the sliding button 131 located outside the housing 110 can be designed to facilitate a finger to apply force, such as setting protrusions or texture to increase friction force in manipulation of the sliding button 131.

In an embodiment, a sliding slot limiting the sliding button 131 is defined by the housing 110. The sliding button 131 is capable of sliding in the sliding slot under an action of an external force. For example, the sliding slot is in a straight-line shape, and a direction of the straight-line is parallel to both the first direction 141 and the second direction 142. The sliding button 131, during sliding in the sliding slot, drives the tubular member 140 and the heater assembly 120 to move. The position of the sliding button 131 in the sliding slot corresponds with the position of the heater assembly 120. For example, the sliding button 131 moves from one end to the other end of the sliding slot, drawing the heater assembly 120 to slide between the heating position and the separation position.

Figure 9:
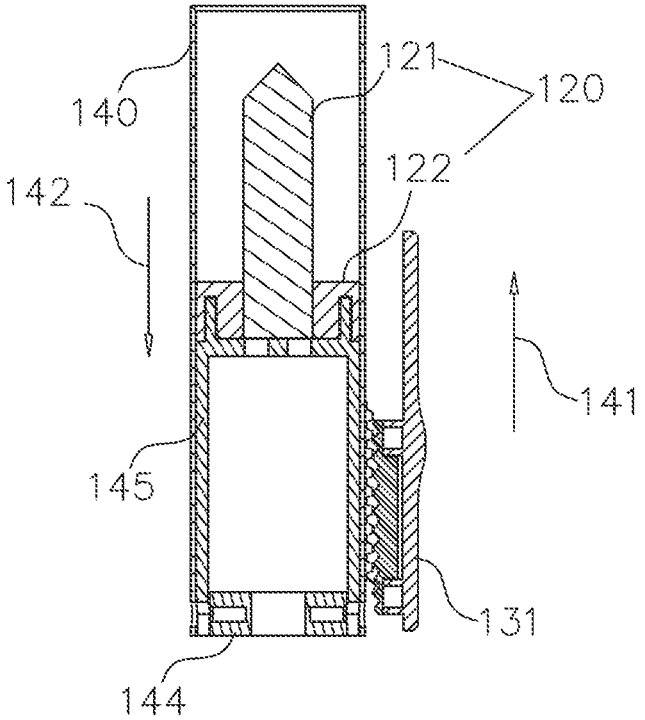
FIG. 9 is a sectional view of the movement mechanism of the aerosol-generating device provided by another embodiment of the present disclosure.

In an embodiment, the moving direction of the sliding button 131 is consistent with the moving direction of the heater assembly 120 (referring to FIG. 9). For example, the sliding button 131 can be directly fixed to the heater assembly 120, and a first position and a second position of the sliding slot (not shown in this figure) can respectively be the two ends of the straight-line shaped sliding slot. The sliding button 131 moves from the bottom end to the top end of the sliding slot, that is, the sliding button 131 is pushed to move along the first direction 141, thereby driving the heater assembly 120 to move from the separation position to the heating position. The sliding button 131 moves from the top end to the bottom end of the sliding slot, that is, the sliding button 131 is pushed to move along the second direction 142, thereby driving the heater assembly 120 to move from the heating position to the separation position.

Figure 10:
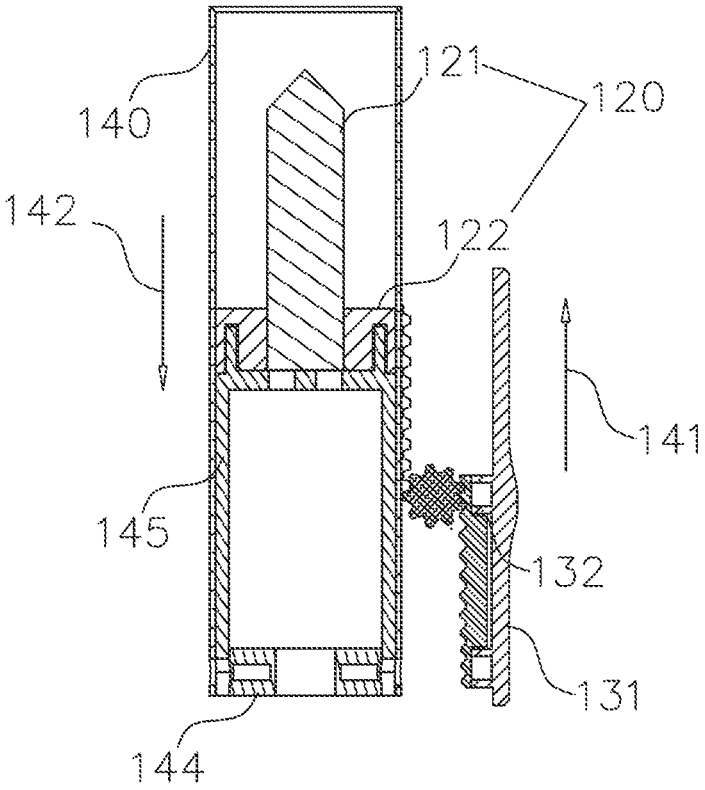
FIG. 10 is a sectional view of the movement mechanism of the aerosol-generating device provided by yet another embodiment of the present disclosure.

In an embodiment, the drive assembly 130 further includes a gear 132 configured for coupling the base 122 with the sliding button 131, so that the base 122 and the sliding button 131 can be movably coupled to transfer the pushing force when the moving directions of the two members are not exactly the same (referring to FIG. 10). For example, the moving direction of the sliding button 131 is opposite to the moving direction of the heater assembly 120. The first position and the second position of the sliding slot can be the two ends of the straight-line shaped sliding slot respectively. The sliding button 131 moves from the bottom end to the top end of the sliding slot, that is, the sliding button 131 is pushed to move along the first direction 141, thereby driving the heater assembly 120 to move from the heating position to the separation position. The sliding button 131 moves from the top end to the bottom end of the sliding slot, that is, the sliding button 131 is pushed to move along the second direction 142, thereby driving the heater assembly 120 to move from the separation position to the heating position. In an embodiment, the gear 132 includes threaded openings, the tubular member 140 is provided with an external thread, the sliding button 131 is provided with an external thread, and the gear 132 is respectively meshed with the external thread on the tubular member 140 and the sliding button 131. The external thread on the tubular member 140 and the external thread on the sliding button 131 are substantially parallel to each other, sandwiching the gear 132 therebetween. The gear 132 transfers the pushing force applied by the sliding button 131 to the tubular member 140, so that the movement directions of the two members are reverse to each other. It is to be noted that the shape of the sliding slot can be arc, spiral, etc., and the pushing force can be transferred by a combination of transmission components to form different gears 132, thereby realizing the movements of the heater assembly 120 along the first direction 141 and the second direction 142.

In an embodiment, the drive assembly 130 can push the heater assembly 120 back in place, that is, push the heater assembly 120 to move from the separation position to the heating position, during which, if the aerosol-generating article 200 has not been removed, the heater 121 abuts against the aerosol-generating article 200 and ejects the aerosol-generating article 200 from the accommodating cavity 111 or pushes the aerosol-generating article 200 to move a certain distance to facilitate the user to take the aerosol-generating article 200 out.

In an embodiment, the aerosol-generating device 100 can further include an extraction assembly 150 configured to assist in pushing the aerosol-generating article 200 out from the accommodating cavity 111 after the heater assembly 120 is withdrawn out and away from the accommodating cavity 111. In an embodiment, when the heater assembly 120 pushed by the drive assembly 130 reaches a position away from the accommodating cavity 111, the drive assembly 130 triggers the extraction assembly 150, so that the extraction assembly 150 pushes the aerosol-generating article 200 to move along the length direction of the accommodating cavity 111, i.e., to move along the first direction 141, directly pushing the aerosol-generating article out or pushing the aerosol-generating article to move for a certain distance to facilitate the user to take the aerosol-generating article out.

In an alternative embodiment, the bottom support 151 can be a part of the element defining the accommodating cavity 111, e.g., can substitute the bottom wall 114.

Figure 11:
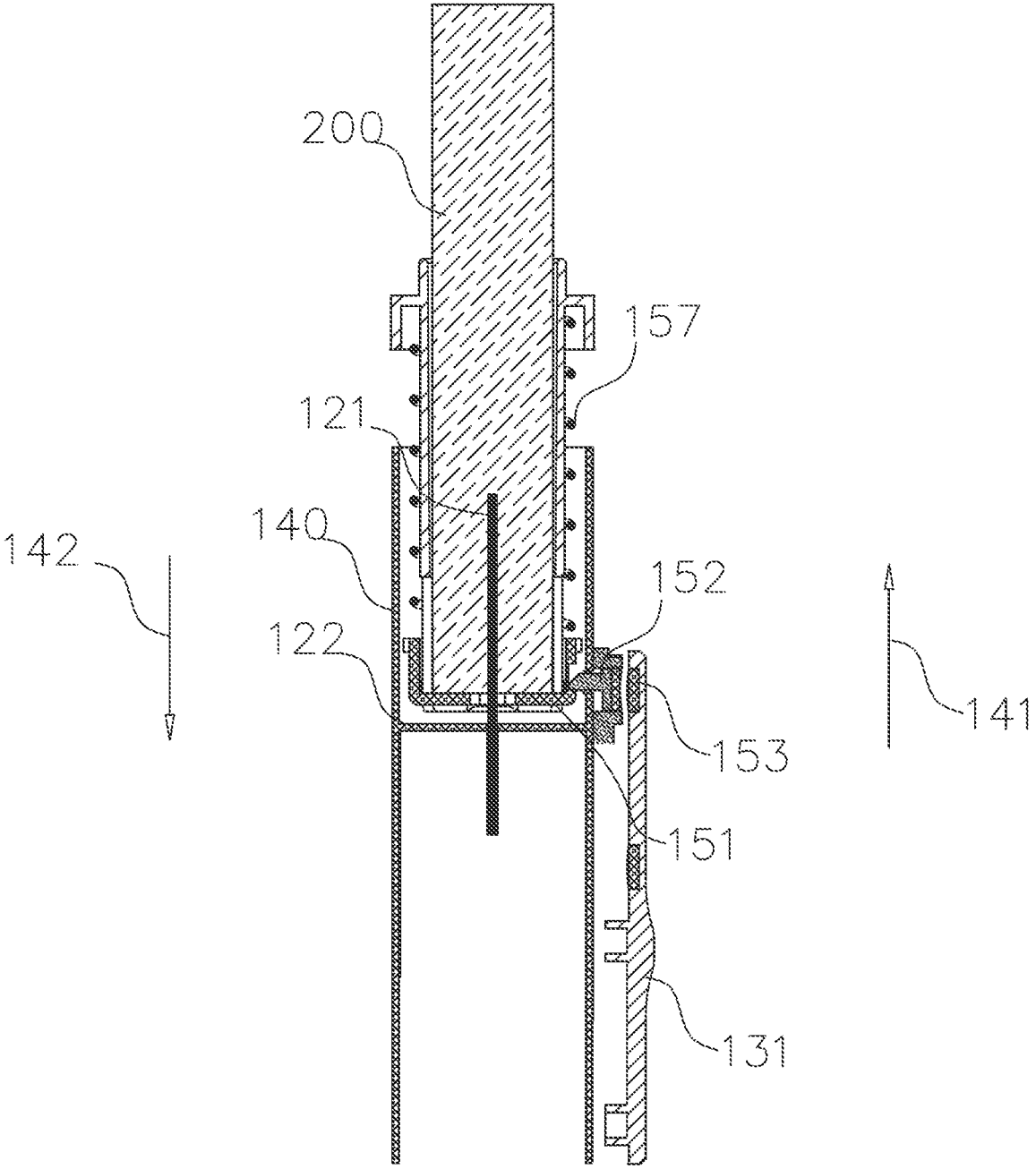
FIG. 11 is a sectional view of the movement mechanism of the aerosol-generating device provided by yet another embodiment of the present disclosure.
Figure 12:
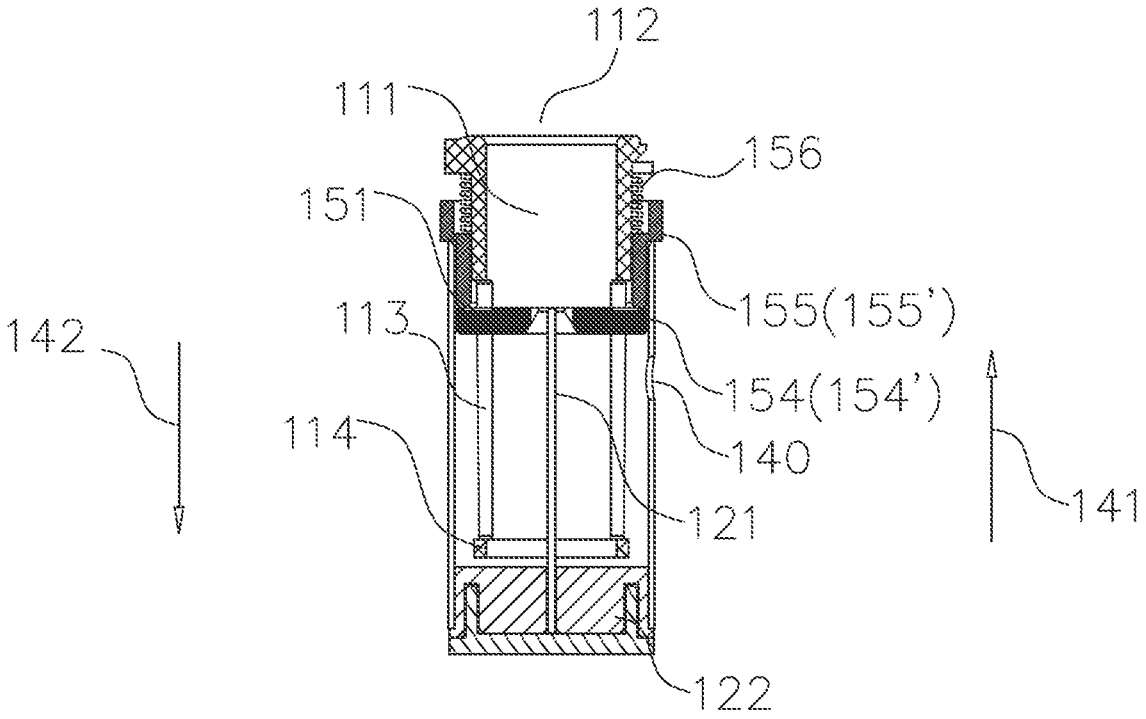
FIG. 12 is a sectional view of an extraction assembly of the aerosol-generating device provided by an embodiment of the present disclosure.

Referring to FIG. 11 and FIG. 12, the linkage assembly includes a retainer 152 and a pulling member 153. The retainer 152 is configured to restrict the bottom support 151 to the bottom of the accommodating cavity 111. The pulling member 153 is configured to generate a force on the retainer 152. When the heater 121 approaches or reaches the separation position, the pulling member 153 pulls the retainer 152, so that the retainer 152 loses the restriction on the bottom support 151. In an embodiment, the retainer 152 is a movable buckle that is detachably connected to the bottom support 151, that is, the movable buckle 152 restricts the bottom support 151 to the bottom of the accommodating cavity 111. When the drive assembly 130 drives the heater assembly 120 to the position away from the accommodating cavity 111, the drive assembly 130 pulls the movable buckle 152, so that the movable buckle 152 is separated from the bottom support 151. The pulling member 153 can be a part of the tubular member 140 or connected to the tubular member 140. When the heater 121 approaches or reaches the separation position, the pulling member 153 moves along with the tubular member 140 to approach the movable buckle 152, and cancels the restriction applied by the movable buckle 152 on the bottom support 151 through an action produced by any means of magnetic attraction, bonding, and buckling. The bottom support 151 then moves along the direction toward the opening 112 of the accommodating cavity 111 under the action of an external force. In an embodiment, preferably, an elastic member 157 is provided to pull the bottom support 151 away from the bottom of the accommodating cavity 111. For example, the elastic member 157 is a tension spring, one end of which is connected to the opening 112 of the accommodating cavity 111, and another end of which is connected to the bottom support 151, providing the puling force to pull the bottom support 151, causing the bottom support 151 to move toward the opening 112. The bottom support 151 moving toward the opening 112 can support and lift the aerosol-generating article 200 away from the accommodating cavity 111 to assist the extraction. When the aerosol-generating article 200 is inserted into the accommodating cavity 111, the aerosol-generating article 200 and the bottom support 151 are both pushed to reach the bottom of the accommodating cavity 111 by an external force, so that the bottom support 151 is buckled by the movable buckle 152. In this way, the bottom support 151 is unable to "return", that is, the bottom support 151 is not able to move along the direction toward the opening 112 until it is triggered by the drive assembly 130 and is separated from the movable buckle 152.

In an embodiment, the tubular wall of the housing 110 that defines the accommodating cavity 111 includes a side wall 113 and a bottom wall 114, which are connected to each other to form the cup-shaped structure. The bottom wall 114 defines a hole through which the heater 121 can be inserted into the aerosol-generating article 200 located in the accommodating cavity 111. The aerosol-generating article 200 further includes a filter. The filter is disposed at an air outflow end of the aerosol-generating article 200, and is opposite to an air inflow end, which is also called the air inlet end, of the aerosol-generating article 200. When the aerosol-generating article 200 is disposed in the accommodating cavity 111 of the aerosol-generating device 100, the filter can be exposed from the opening 112 for the user to puff. The air inflow end abuts against the bottom wall 114, so that the hole defined by the bottom wall 144 is also capable of allowing air to flow therethrough into the aerosol-generating article 200. As the user puffs, the heater 121 heats the aerosol-generating material to generate mist containing aerosol. The mist is then transported to the user's mouth with the air flow. The air flows through the hole defined by the bottom wall 114, then passes through the aerosol-generating material and flows adjacent to the aerosol-generating material, so that the size and shape of the hole can be set to control the air flow and, therefore, to control characteristics of the aerosol.

In an embodiment, the movable buckle 152 can move along a direction perpendicular to the length direction of the accommodating cavity 111. The length direction of the accommodating cavity 111 is also an extension direction of the heater 121. When the movable buckle 152 is adjacent to the accommodating cavity 111, the movable buckle 152 restricts the bottom support 151 to the bottom of the accommodating cavity 111. When the movable buckle 152 is away from the accommodating cavity 111, the movable buckle 152 is separated from the bottom support 151.

In an embodiment, the linkage assembly includes a first member 154 and a second member 155. The first member 154 is disposed on the bottom support 151. The second member 155 is bonded to the first member 154 when the heater 121 approaches or reaches the separation position. It can be understood that the second member 155 and the first member 154 move along the same direction when they are bonded together. For example, the second member 155 is a part of the tubular member 140 or connected to the tubular member 140, that is, the second member 155 and the tubular member 140 move along the same direction. When the tubular member 140 pulls the heater assembly 120 to move along the second direction 142, the second member 155 gradually approaches the first member 154. The second member 155 and the first member 154 are not bond together until the heater 121 approaches or reaches the separation position. Then the second member 155 and the first member 154 move together with the tubular member 140 along the first direction 141, so that the bottom support 151 is pulled to move away from the bottom of the accommodating cavity 111, thereby assisting the aerosol-generating article 200 in exiting the accommodating cavity 111.

In an embodiment, the second member 155 and the first member 154 are engaged by any one of magnetic attraction, bonding, and snapping. For example, the second member 155 and the first member 154 can be bonded together by magnetic attraction. When the tubular member 140 moves along the first direction 141, under the action of the magnetic attraction force, the bottom support 151 and the aerosol-generating article 200 can be pushed to move away from the bottom of the accommodating cavity 111. For example, the first member 154 is a magnet 154' disposed on the bottom support 151, and the second member 155 is an iron ring 155' outside surrounding the accommodating cavity 111. The iron ring 155' abuts against the top of the tubular member 140 under a pushing force applied by a spring 156. One end of the spring 156 is connected to the opening 112 communicated with the accommodating cavity 111, and the other end of the spring 156 is connected to the iron ring 155'. The spring 156 provides a continuous pushing force to the iron ring 155', so that the iron ring 155' is pushed to abut against the top of the tubular member 140, and so that the iron ring 155' and the tubular member 140 are moved together. When the heater 121 approaches or reaches the separation position, the magnet 154' and the iron ring 155' are attracted with each other. Under the action of this magnetic attraction force, the bottom support 151 and the aerosol-generating article 200 can also be pushed to move away from the bottom of the accommodating cavity 111 when the tubular member 140 moves along the first direction 141 changed from along the second direction 142.

Certainly, the bonding can also be replaced by joining means such as a hook-and-loop fastener, a glue, etc., or replaced by snapping means such as a snap, a buckle, etc. For example, the first member 154 is a stud, and the second member 155 is a snapping aperture disposed on the inner wall of the tubular member 140. When the heater 121 reaches the separation position, the stud is protruded into and joined with the snapping aperture. When the tubular member 140 moves along the first direction 141, the tubular member 140 drives the bottom support 151 and the aerosol-generating article 200 to move therewith toward the opening 112 of the accommodating cavity 111.

Figure 13:
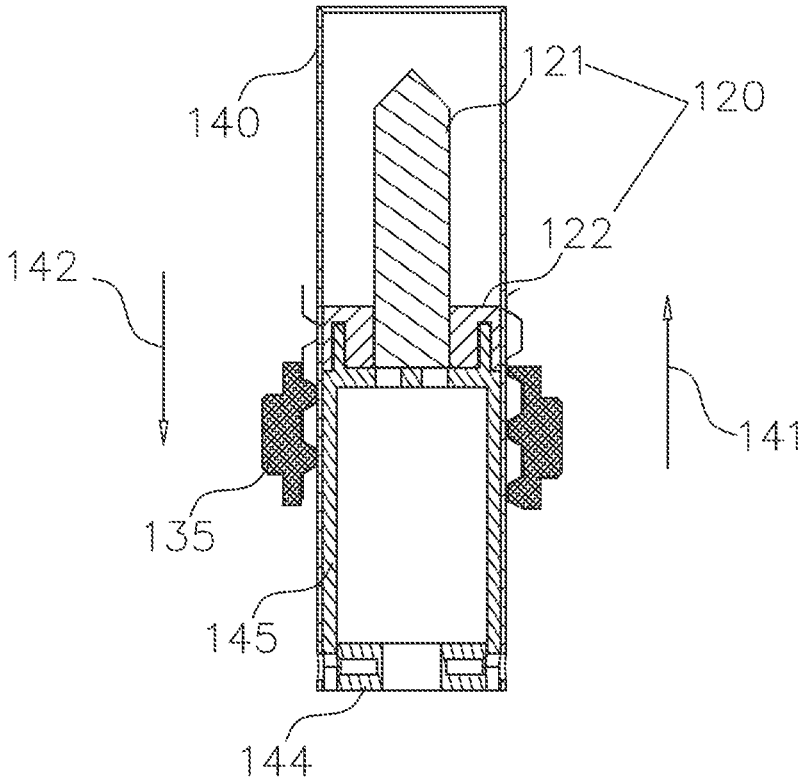
FIG. 13 is a sectional view of the movement mechanism of the aerosol-generating device provided by yet another embodiment of the present disclosure.

Referring to FIG. 13, in the aerosol-generating device 100 provided by an embodiment of the present disclosure, the drive assembly 130 includes a rotary knob 135, and the rotary knob 135 is movably coupled to the housing 110. The rotary knob 135 rotates around the housing 110 to push the heater assembly 120, so that the heater assembly 120 slides between the position extended into the accommodating cavity 111 and the position withdrawn away from the accommodating cavity 111. For example, an outer thread is disposed on the outer periphery of the tubular member 140, the rotary knob 135 is cylindrical, and an inner thread is disposed on the inner periphery of the rotary knob 135. The outer thread of the tubular member 140 engages with the inner thread of the rotary knob 135. The rotary knob 135 is arranged on the outer periphery of the housing 110 and can be designed to facilitate fingers to apply force, such as setting protrusions or texture to increase friction force in manipulation of the rotary knob 135. Except the difference that the rotary knob 135 pushes the heater assembly 120, the movements of other structures of the present embodiment are the same as those in the above-described embodiments, and will not be repeated herein.

Figure 14:
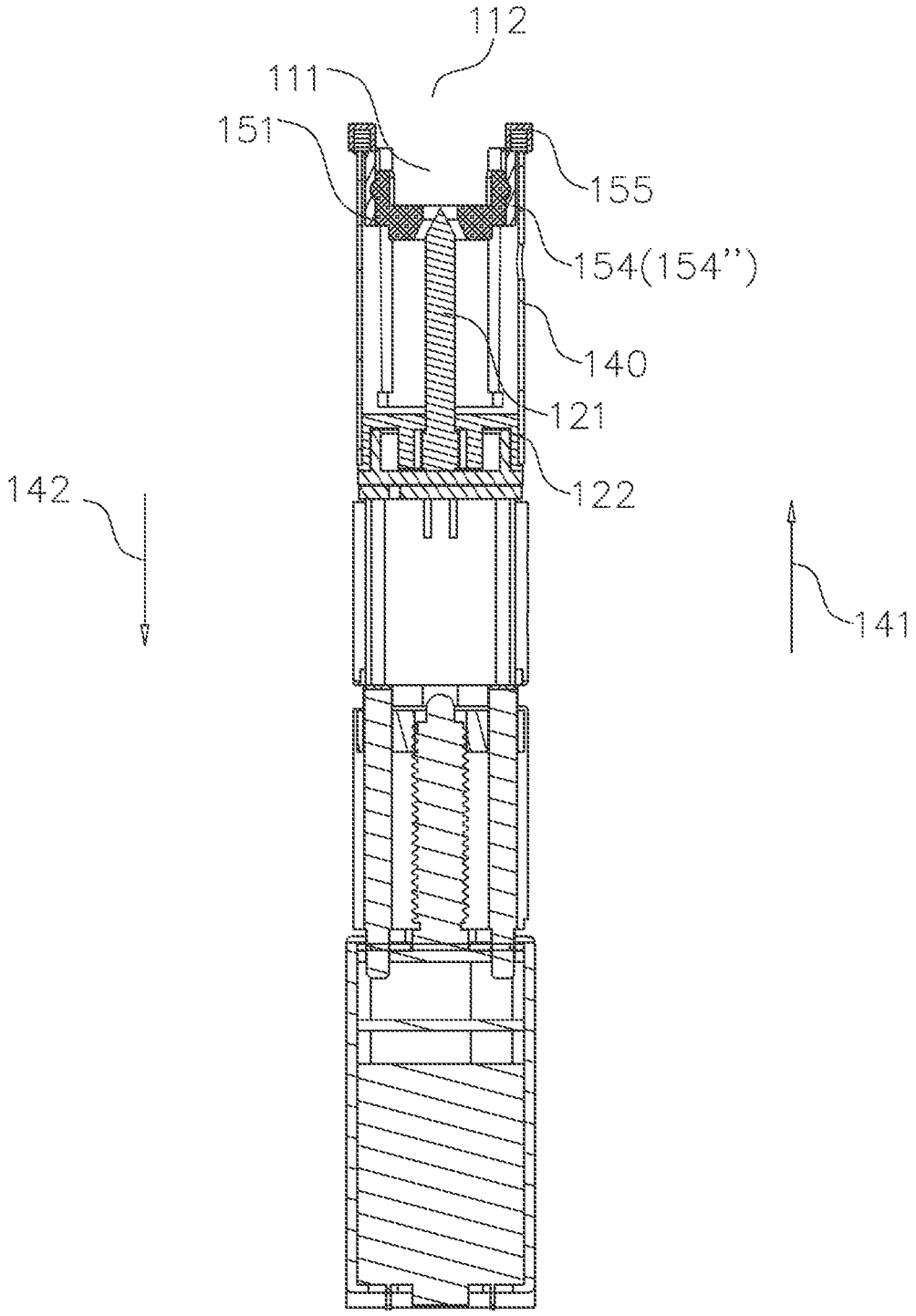
FIG. 14 is a sectional view of a portion of the aerosol-generating device provided by another embodiment of the present disclosure.
Figure 15:
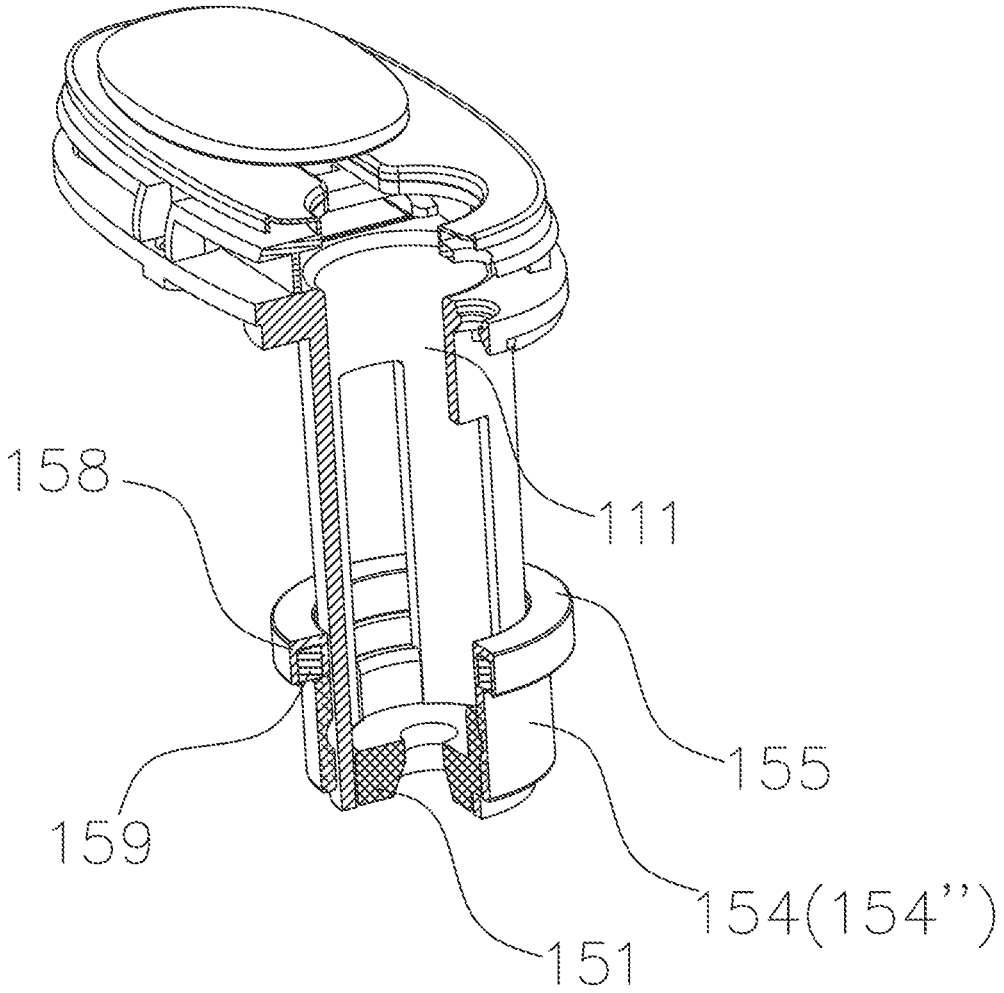
FIG. 15 is a perspective sectional view of a portion of the aerosol-generating device provided by another embodiment of the present disclosure.

Referring to FIG. 14 and FIG. 15, in another embodiment of the present disclosure, the first member 154 is a fixing hoop 154". The fixing hoop 154" surrounds the outer periphery of the tubular wall defining the accommodating cavity 111. The fixing hoop 154" and the bottom support 151 are slidably connected to the housing defining the accommodating cavity 111. The fixing hoop 154" and bottom support 151 are fixedly connected together, move under the traction of the second member 155, and engaged by any one of magnetic attraction, bonding, and snapping. For example, the second member 155 and the fixing hoop 154" can be bonded together by magnetic attraction: the fixing hoop 154" is an iron ring, and at least a part of the second member 155 is a magnet; or, the second member 155 is an iron ring, and at least a part of the fixing hoop 154" is a magnet; or both of them are magnets. Under the action of the magnetic attraction between the two members, the bottom support 151 and the aerosol-generating article 200 can be pushed to move away from the bottom of the accommodating cavity 111 when the tubular member 140 moves along the first direction 141. The fixing hoop 154" can be an iron ring, which is fixed with the bottom support 151 through a snapping aperture, or interference fit fixation can be achieved by controlling the sizes of the two members, so that the two members can slide together along the accommodating cavity 111. The second member 155 is similar to that shown in FIG. 12. The second member 155 abuts against the top of the tubular member 140 under a pushing force applied by a spring. One end of the spring is connected to the opening 112 communicated with the accommodating cavity 111, and the other end of the spring is connected to the second member 155. The spring provides a continuous pushing force to push the second member 155, so that the second member 155 is pushed to abut against the top of the tubular member 140, and so that the second member 155 and the tubular member 140 are moved together. When the heater 121 approaches or reaches the separation position, the fixing hoop 154" and the second member 155 are attracted with each other. Under the action of the magnetic attraction force, the bottom support 151 and the aerosol-generating article 200 can also be pushed to move away from the bottom of the accommodating cavity 111 when the tubular member 140 moves along the first direction 141 changed from along the second direction 142.

Figure 16:
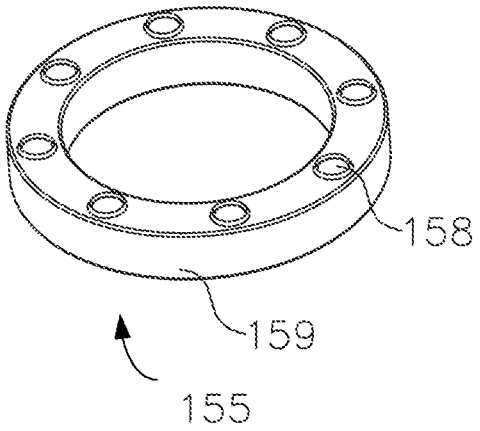
FIG. 16 is a perspective view of a second member provided by an embodiment of the present disclosure.

Referring to FIG. 16, in an embodiment, the second member 155 includes a substrate 159 and a magnet 158 fixed on the substrate 159. In an embodiment, the substrate 159 is a material with good moldability, such as a plastic substrate. At least one mounting hole for fixing the magnet 158 is defined on the substrate 159. In an embodiment, the number of the mounting holes is 2 to 10. The magnet 158 can be small cylindrical particles embedded in the substrate 159 through interference fit, which are convenient for molding and can make the second member 155 magnetic. The substrate 159 can also be a strength-enhancing substrate, such as a metal substrate, which uses its own strength to enhance the strength of the second member 155. The second member 155 can be a metal plate or a metal U-shaped ring, which is fixed with the magnet. For example, the metal plate is attached to the outer surface of the magnet 158, or the magnet 158 is embedded in the metal U-shaped ring, or the magnet is combined with the substrate 159 in sintering and cooling processes of the magnet. The coercivity and service life of the second member 155 can be improved under the assistance of the metal material having relatively good coercivity and molding performance. In an embodiment, the drive assembly 130 can push the tubular member 140 to move along the first direction 141, and then the tubular member 140 is moved along the second direction 142 until reaches the separation position. During the movement of the tubular member 140 along the first direction 141, the tubular member 140 can push the tubular wall defining the accommodating cavity 111 and the aerosol-generating article 200 inserted therein along the direction toward the opening 112, to achieve the effect of extracting the aerosol-generating article 200 out. In order to prevent the aerosol-generating article 200 from being drawn back while the tubular member 140 moves to the separation position along the second direction 142, a restriction structure can be set to fix the tubular wall defining the accommodating cavity 111, so that both the tubular member 140 and heater 121 are moved along the second direction 142 to the separation position, whereas the tubular wall defining the accommodating cavity 111 and the aerosol-generating article 200 are not moved along the second direction 142 to the separation position, realizing the separation of the aerosol-generating article 200 from the heater 121.

Figure 17:
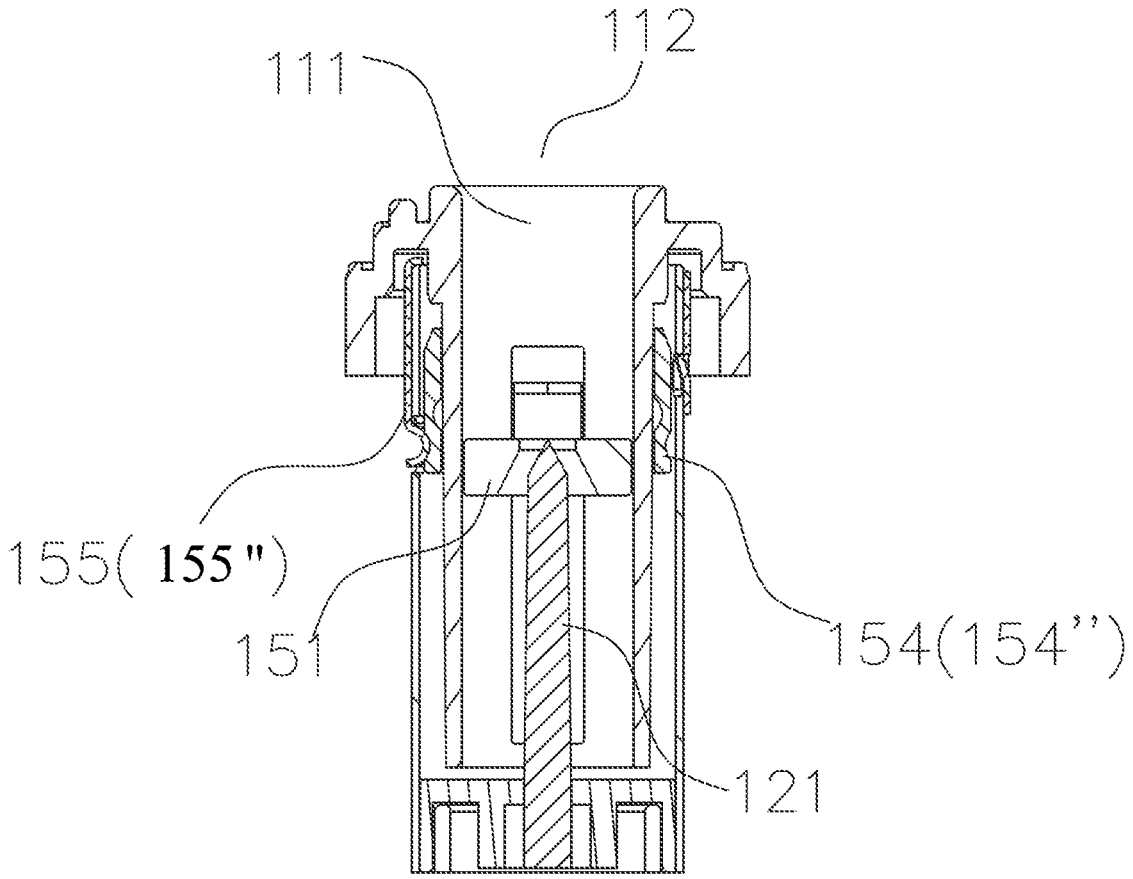
FIG. 17 is a sectional view of an extraction assembly of the aerosol-generating device provided by another embodiment of the present disclosure.

Referring to FIG. 17 and FIG. 15, in another embodiment of the present disclosure, the first member 154 is a fixing hoop 154". The fixing hoop 154" surrounds the outer periphery of the tubular wall defining the accommodating cavity 111. The fixing hoop 154" and the bottom support 151 are slidably connected to the housing defining the accommodating cavity 111. The fixing hoop 154" is fixedly connected to the bottom support 151. For example, the part of the bottom support 151 that extends out from a slot is snap-fit with a groove or a notch on an inner surface of the fixing hoop 154". The second member 155 is an elastic claw 155". When the drive assembly 130 (which is the same as that in the previous embodiments) pushes the heater 121 to the position out and away from the accommodating cavity 111, the claw 155" is joined to the fixing hoop 154". The elastic claw 155" and the fixing hoop 154" are joined by the elastic force provided by the elastic claw 155". The joining force between the claw 155' and the fixing hoop 154" can push the bottom support 151 and the aerosol-generating article 200 to move away from the bottom of the accommodating cavity 111 when the heater 121 moves along the first direction 141 changed from along the second direction 142.

It should be noted that the drive assembly 130 provided by the present disclosure is not limited to the structures exemplified in the above-described embodiments. The drive assembly 130 that provides driving force in other form (e.g., the other forms of the drive assembly 130 including but not limited to electric motors, pneumatic pumps, hydraulic pumps, electromagnets, etc.) to push the heater assembly 120 to slide between the position extending into the accommodating cavity 111 and the position withdrawn out and away from the accommodating cavity 111 all falls within the protection scope of the present disclosure.

Figure 7:
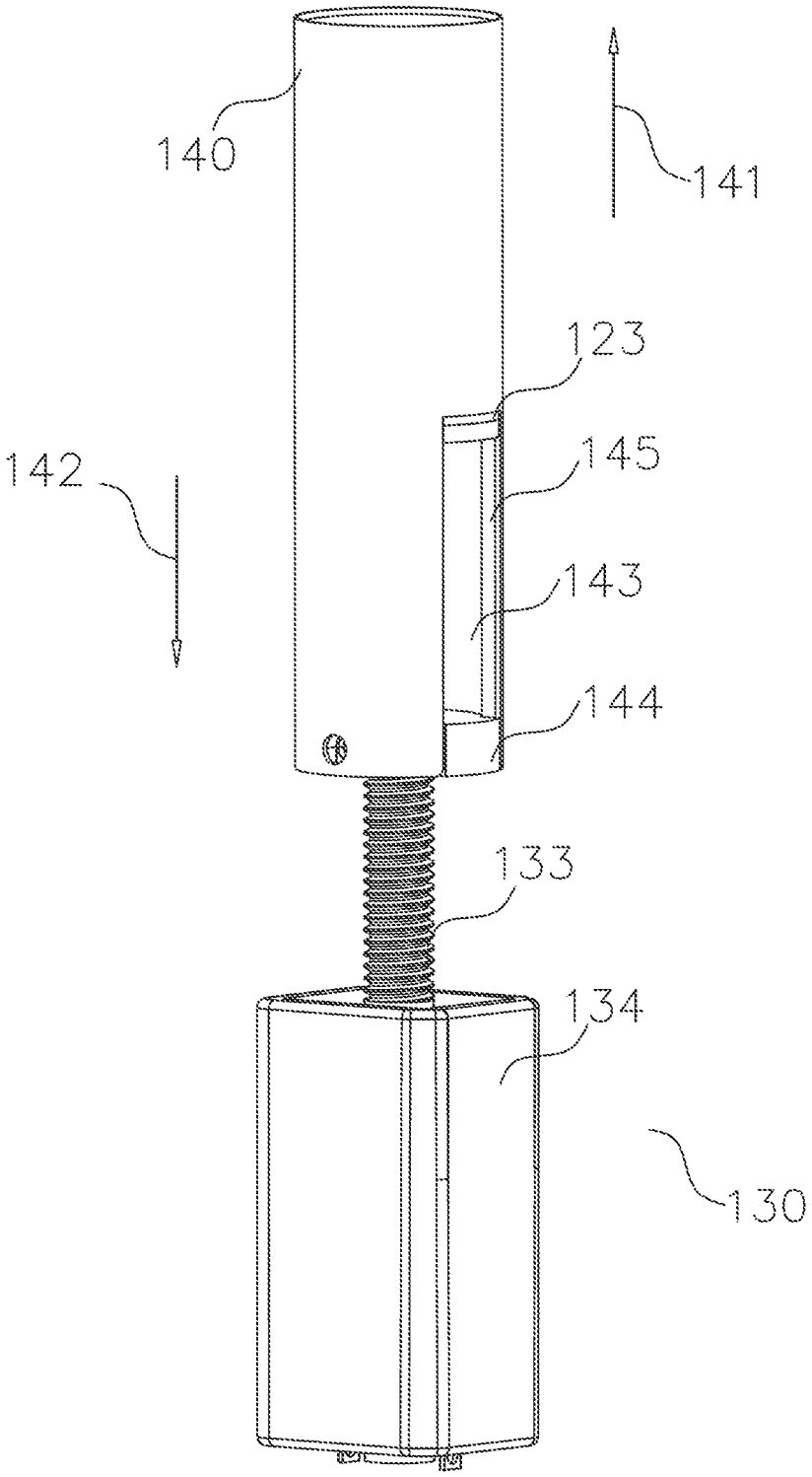
FIG. 7 is a schematic structural view of a movement mechanism of the aerosol-generating device provided by an embodiment of the present disclosure.
Figure 8:
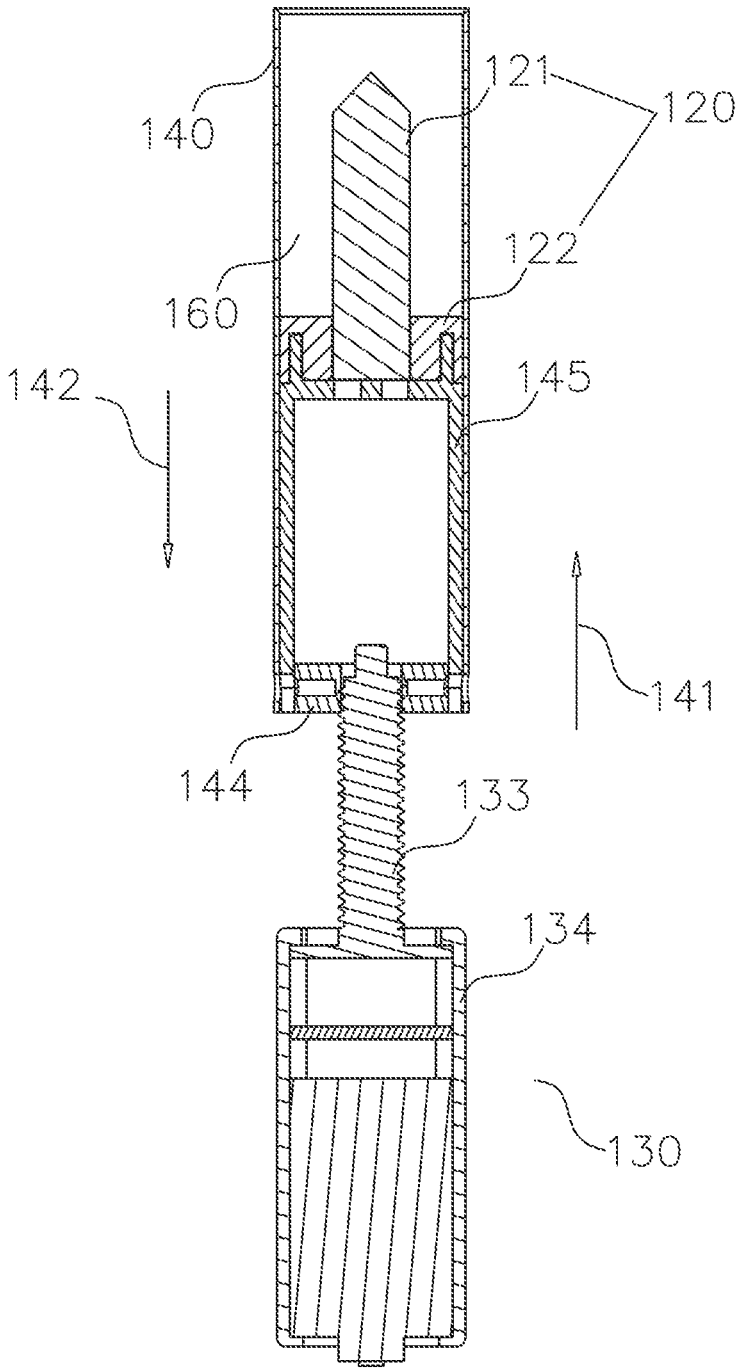
FIG. 8 is a sectional view of the movement mechanism in FIG. 7.

In an embodiment, referring to FIG. 7, a slot aperture 143 is defined by the tubular member 140. A protrusion 123 on the base 122 is protruded into the slot aperture 143 and is restricted in position. The protrusion 123 is disposed on the base 122. The protrusion 123 can be single or multiple. The number of the protrusion 123 is equal to the number of the slot aperture 143. The shape of the protrusion 123 and the shape of the slot aperture 143 are matched. The protrusion 123 is installed in the slot aperture 143 and is restricted and unable to rotate.

In an embodiment, the slot aperture 143 extends along the length direction of the tubular member 140 to the end of the tubular member 140, so that the protrusion 123 on the base 122 is capable of sliding along the slot aperture 143 and installed therein. In order to prevent the heater assembly 120 from sliding out along the slot aperture 143, a fixing auxiliary 145 is disposed to abut against the base 122 of the heater 121. The fixing auxiliary 145 is disposed in the hollow interior of the tubular member 140. The fixing auxiliary 145 is fixedly connected to the tubular member 140 in at least one of the methods such as screws, glue, and interference fit.

In an embodiment, a connecting member 144 is fixedly disposed at one end, away from the heater 121, of the tubular member 140. The drive assembly 130 is connected to or movably coupled to the tubular member 140 through the connecting member 144. For example, the drive assembly 130 adopts an electric motor 134 as a power source, and is movably connected to the connecting member 144 through a threaded shaft 133. The threaded shaft 133 has an external thread, and the connecting member 144 has an internal thread. The threaded shaft 133 penetrates the connecting member 144, and the threads thereof are engaged. The rotation of the electric motor 134 drives the threaded shaft 133 to rotate, so that the threaded shaft 133 pushes the tubular member 140 to move along the first direction 141 and the second direction 142. In order to prevent the rotating threaded shaft 133 from driving the tubular member 140 to rotate, a crossbeam (not shown in the figure) is disposed on the housing 110, the crossbeam is inserted into the slot aperture 143, and the extension direction of the crossbeam is perpendicular to the length direction of the tubular member 140, In this way, the rotation of the tubular member 140 is avoided, and the tubular member 140 can only move along the first direction 141 and the second direction 142. The crossbeam slides along the slot aperture 143 during the movement of the tubular member 140. For example, two slot apertures 143 are oppositely arranged. The crossbeam passes through the two slot apertures 143, thereby penetrating the tubular member 140 along the direction perpendicular to the length direction of the tubular member 140.

In an embodiment, the connecting member 144 is fixed at the end, away from the heater 121, of the tubular member 140, and the interior of the tubular member 140 is hollow. In order to fix the base 122, the fixing auxiliary 145 can be directly disposed in the hollow interior of the tubular member 140. One end of the fixing auxiliary 145 abuts against the base 122 of the heater 121, and another end of the fixing auxiliary 145 abuts against the connecting member 144. The fixing auxiliary 145 is fixed by the connecting member 144, to restrict the position of the base 122 to the distal end of the slot aperture 143 and to be unmovable. In an embodiment, the fixing auxiliary 145 also has a hollow interior, so that the threaded shaft 133 can enter the hollow interior of the fixing auxiliary 145 during the rotation.

Other forms of the drive assembly 130, such as a pneumatic pump, a hydraulic pump, an electromagnet, etc., can also achieve the above-described objects. For example, the pneumatic pump or the hydraulic pump can be used directly instead of the electric motor 134; and a transmission rod can be connected to the connecting member 144, instead of the threaded shaft 133, and to push the tubular member 140. In the embodiment using an electromagnet as the drive assembly 130, the electromagnet is used instead of the electric motor 134, and a magnetic element is used instead of the connecting member 144. When the electromagnet attracts the magnetic element, the tubular member 140 is pushed to move along the first direction 141. When the electromagnet repels the magnetic element, the tubular member 140 is pushed to move along the second direction 142. In an embodiment, the direction of the magnetic field generated by the electromagnet can be changed. The direction of the magnetic field can be changed by changing the direction of a current flow, which facilitates the control of the movement direction of the tubular member 140.

The technical features of the above-described embodiments can be arbitrarily combined. In order to make the description simple, not all possible combinations of the technical features in the above embodiments are described. However, as long as there is no contradiction in the combination of these technical features, the combinations should be in the scope of the present disclosure.

What described above are only some embodiments of the present disclosure, and these embodiments are specific and detailed, but not intended to limit the scope of the present disclosure. It should be understood by the skilled in the art that various modifications and improvements can be made without departing from the conception of the present disclosure, and all fall within the protection scope of the present disclosure. Therefore, the patent protection scope of the present disclosure is defined by the appended claims.

What is claimed is:

1. An aerosol-generating device, comprising:

a housing provided with an accommodating cavity configured to accommodate an aerosol-generating article;

a heater assembly comprising a heater and a base fixing the heater, the heater being configured to be inserted into the aerosol-generating article to heat an aerosol-generating material in the aerosol-generating article, thereby generating aerosol;

a bottom support slidably connected to the housing, a movement direction of the bottom support being parallel to a length direction of the accommodating cavity;

a drive assembly movably coupled to the heater assembly and configured to push or drawn the heater assembly, thereby allowing the heater assembly to slide between a heating position and a separation position, the heating position being a position of the heater that is extended into the accommodating cavity, the separating position being another position of the heater that is withdrawn out and away from the accommodating cavity; and a linkage assembly configured to trigger a movement of the bottom support toward an insertion opening of the accommodating cavity when the heater approaches or reaches the separation position.

2. The aerosol-generating device of claim 1, wherein the linkage assembly comprises:

a retainer configured to restrict the bottom support to a bottom of the accommodating cavity; and a pulling member configured to generate a force on the retainer, wherein when the heater approaches or reaches the separation position, the pulling member pulls the retainer, thereby causing the retainer to lose the restriction on the bottom support.

3. The aerosol-generating device of claim 2, further comprising an elastic member, wherein the elastic member is connected to the bottom support, and configured to pull the bottom support, thereby causing the bottom support to move toward the insertion opening of the accommodating cavity.

4. The aerosol-generating device of claim 1, wherein the linkage assembly comprises:

a first member disposed on the bottom support or fixedly connected to the bottom support; and a second member, wherein the second member is bonded to the first member when the heater approaches or reaches the separation position.

5. The aerosol-generating device of claim 4, wherein the second member and the first member are bonded by any one of magnetic attraction, bonding, and snapping.

6. The aerosol-generating device of claim 5, wherein the housing comprising a tubular wall defining the accommodating cavity, the first member is a fixing hoop fixedly connected to the bottom support, and the fixing hoop surrounds an outer periphery of the tubular wall.

7. The aerosol-generating device of claim 6, wherein the bottom support and the fixing hoop are fixedly connected by snapping or interference fit.

8. The aerosol-generating device of claim 6, wherein at least a part of the second member is a magnet, which is capable of bonding to the first member by magnetic attraction.

9. The aerosol-generating device of claim 8, wherein the second member comprises a substrate and a magnet fixed on the substrate.

10. The aerosol-generating device of claim 5, further comprising a tubular member, wherein the heater assembly is fixed inside the tubular member, and the tubular member is connected to or movably coupled to the drive assembly.

11. The aerosol-generating device of claim 10, wherein the second member is a part of the tubular member or abuts against the tubular member, and the second member gradually approaches the first member while the tubular member moves from the heating position to the separation position.

12. The aerosol-generating device of claim 10, wherein a shape of the base is adapted to a hollow interior of the tubular member, and an outer edge of the base fits tightly with an inner wall of the tubular member.

13. The aerosol-generating device of claim 10, wherein the tubular member surrounds an outer periphery of the heater.

14. The aerosol-generating device of claim 10, wherein the tubular member is provided with a slot aperture, and a protrusion on the base is protruded into the slot aperture and is restricted in position.

15. The aerosol-generating device of claim 14, wherein the slot aperture extends along a length direction of the tubular member.

16. The aerosol-generating device of claim 15, wherein a connecting member is fixedly disposed at one end, away from the heater, of the tubular member, and the drive assembly is connected to or movably coupled to the tubular member through the connecting member.

17. The aerosol-generating device of claim 16, further comprising a fixing auxiliary, wherein the fixing auxiliary is disposed in the hollow interior of the tubular member, one end of the fixing auxiliary abuts against the base of the heater, and another end of the fixing auxiliary abuts against the connecting member.

18. The aerosol-generating device of claim 17, wherein a crossbeam is disposed on the housing, and the crossbeam is inserted into the slot aperture and slides along the slot aperture while the tubular member moves.

19. The aerosol-generating device of claim 18, wherein the crossbeam penetrates the tubular member along a direction perpendicular to the length direction of the tubular member.

20. The aerosol-generating device of claim 1, wherein the bottom support is provided with a hole through which the heater is capable of being inserted into the aerosol-generating article received in the accommodating cavity.

* * * * *